US006354719B1

(12) United States Patent
Pan

(10) Patent No.: US 6,354,719 B1
(45) Date of Patent: Mar. 12, 2002

(54) CONNECTING STRUCTURE OF A BULB HOLDER OF A DECORATIVE LIGHT STRING

(76) Inventor: Wun Fang Pan, No. 123, Lane 99, Din Pu Road, Hsinchu (TW)

( * ) Notice: Subject to any disclaimer, the term of this patent is extended or adjusted under 35 U.S.C. 154(b) by 0 days.

(21) Appl. No.: 09/464,750

(22) Filed: Dec. 16, 1999

(51) Int. Cl.[7] ..... F21V 21/00
(52) U.S. Cl. ..... 362/391; 362/396; 362/249
(58) Field of Search ..... 362/391, 249, 362/252, 431, 71; 439/699.2, 619

(56) References Cited

U.S. PATENT DOCUMENTS 5,570,952 A * 11/1996 Protz, Jr. ..... 362/431
5,839,819 A * 11/1998 Pan ..... 362/252
6,036,538 A * 3/2000 Lin ..... 362/249
6,048,074 A * 4/2000 Wang ..... 362/266
6,059,425 A * 5/2000 Wang ..... 362/249

* cited by examiner

*Primary Examiner*—Alan Cariaso
*Assistant Examiner*—Bao Truong
(74) *Attorney, Agent, or Firm*—Rosenberg, Klein & Lee

(57) ABSTRACT

The invention relates to a connecting structure of a light bulb holder, which is provided with an easy connecting design at the outside walls of the body for effective connecting with electric wires securely. The invention is particularly used in a net-type or a curtain-type decorative light string. By use of enough connecting strength, the bulb holders are able to connect with the wires in order that the complete decorative configuration can be obtained and remained perfectly.

2 Claims, 4 Drawing Sheets

CONNECTING STRUCTURE OF A BULB HOLDER OF A DECORATIVE LIGHT STRING

BACKGROUND OF THE INVENTION

A net-type decorative light string or a curtain-type one is popular in prior known use. This known structure uses a single elastic hook to connect with the electrical wire of which the connecting strength is not enough. In use, even an accidental pulling, the bulb holder will be separated from the wires. The net-type or curtain-type decorative configuration is then incomplete.

Accordingly, it is a main purpose of the present invention to provide a connecting structure of a bulb holder, which is capable of firmly connecting with the electric wires, that solves the problem of the prior design.

DETAILED DESCRIPTION OF THE PREFERRED EMBODIMENT

Figure 1:
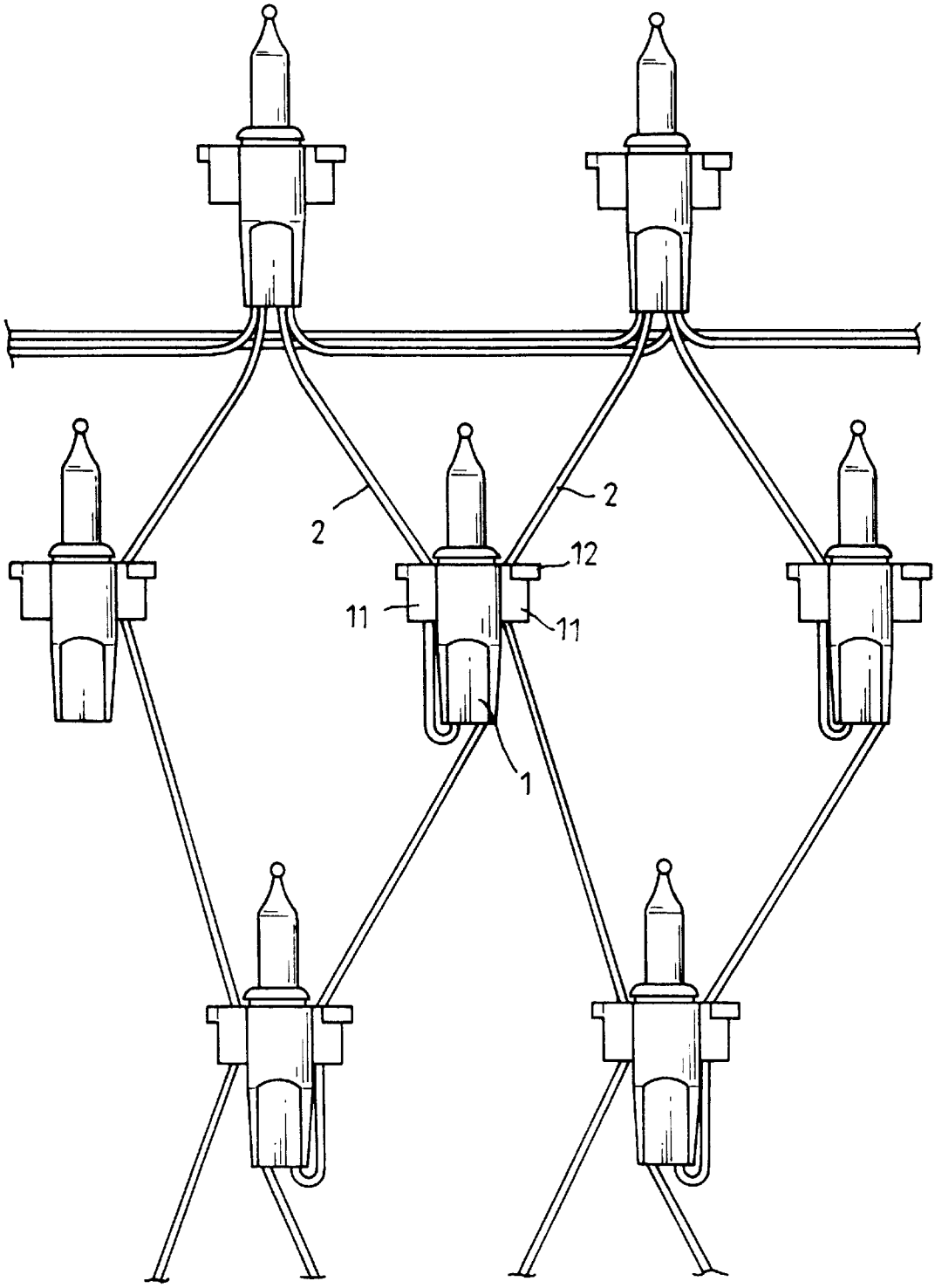
FIG. 1 is a plan view of an exemplary embodiment of the present invention as in a net-type configuration.
Figure 2:
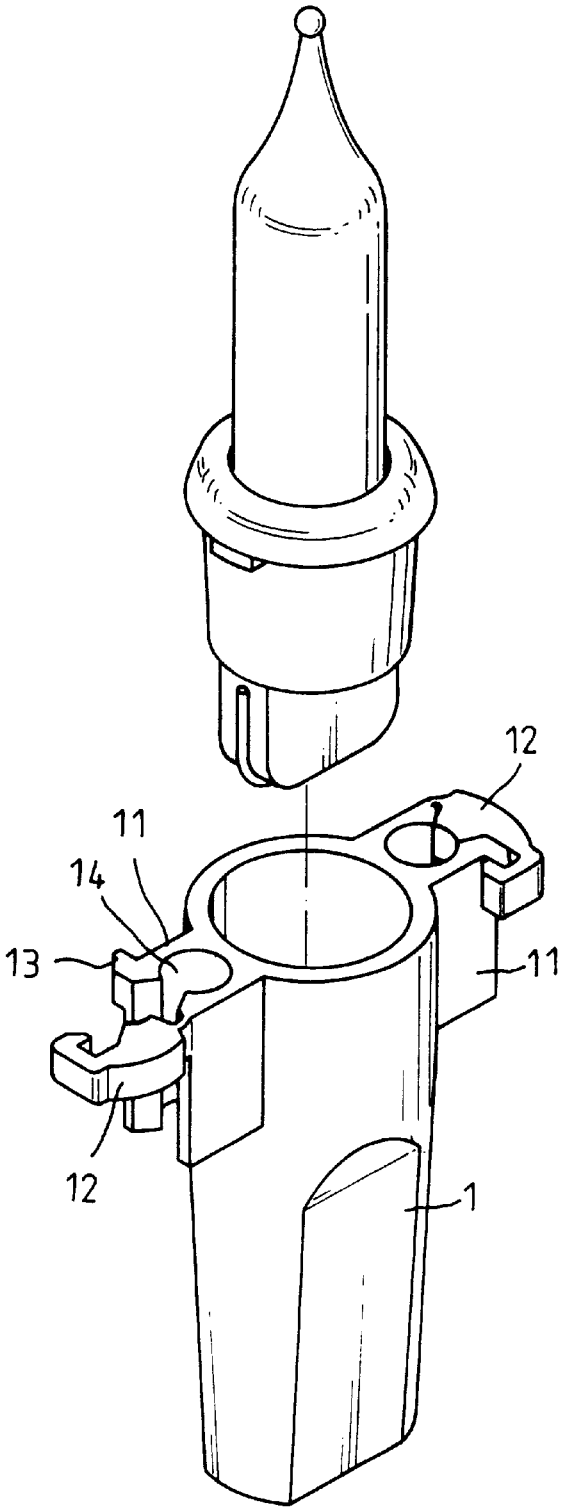
FIG. 2 is an exploded perspective view of a bulb holder with a bulb set.
Figure 3:
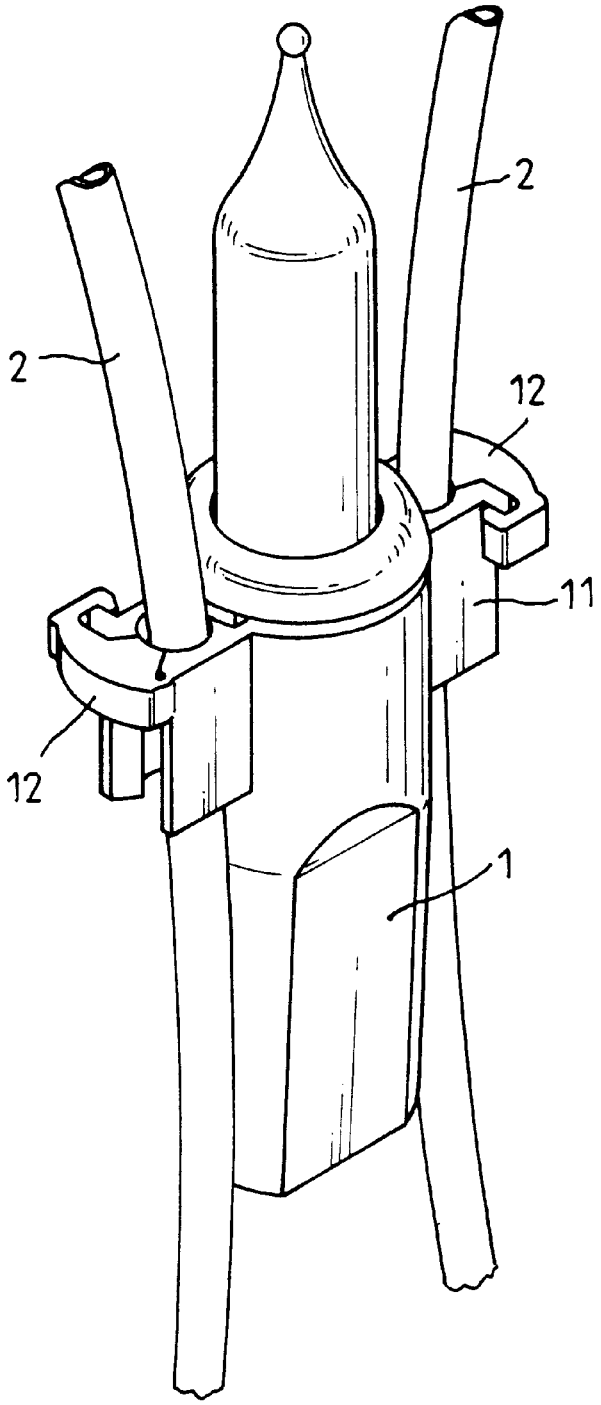
FIG. 3 is an assembly of FIG. 2 connecting the electric wires of this invention.

Referring to FIG. 1, it shows a net-type decorative light string of the present invention, wherein each of the bulb holder (1) is provided with a pair of connecting structures at both sides of the hollow body to assemble a related electric wire (2). It is a most character of this invention that the design of the connecting structure, wherein a connecting base (11) with a circular groove (14) is formed at a outside wall of the bulb holder (1). An end of the connecting base (11) is provided with a convex edge (13) and another end with a connecting hook (12), which is able to be moved to engaged with the convex edge (13) very easily. When the wire (2) is placed in the groove (14) and then the connecting hook (12) is to engage with the edge (13), it can be seen, as shown in FIGS. 2 and 3, that the wire (2) is firmly assembled with the bulb holder (1) effectively.

Figure 4:
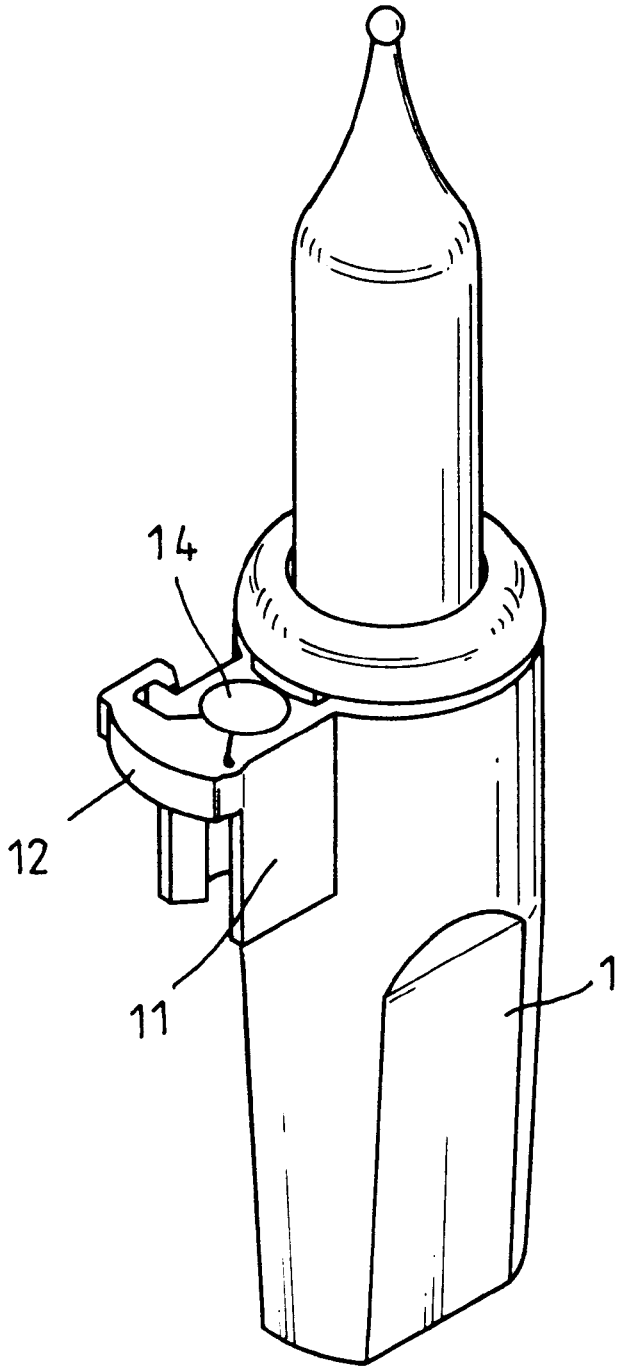
FIG. 4 is a perspective view of a modified light bulb holder.

Since the connection force between the hook and the edge provides an enough strength better than the prior art, the complete net-type decorative configuration according to the present invention is promised that overcomes the said prior drawback and gains an obvious improvement. As shown in FIG. 4, it shows a bulb holder (1) with a single connecting structure, which is capable of being use in a curtain-type decorative light string under the scope of this invention.

I claim:

1. A light bulb holder for a netted decorative light string having a first and at least a second light bulb, said light bulb holder comprising:

(a) a longitudinally extended holder part having a central through opening for internally receiving therein a light bulb socket of said first light bulb;

(b) at least one connecting part coupled to said holder part for securely clasping an electric wire extending from said at least second light bulb, said connecting part including:

(1) a connecting base extending laterally from said holder part, said connecting base having a pair of opposing wall portions describing a longitudinal groove therebetween, said wall portions having respective terminal ends spaced one from the other by a gap communicating with said groove, at least one of said terminal ends having a convex edge protrusion formed thereon; and, (2) a connecting hook integrally formed to extend from at least one of said terminal ends of said connecting base, said connecting hook being deflectable to a closed position, said connecting hook in said closed position lockingly engaging said convex edge protrusion and extending across said gap, an intermediate portion of said connecting hook extending transversely into said gap to cooperatively define with said connecting base a circularly contoured channel for engaging in conformed manner one electric wire of said at least second light bulb therein.

2. The light bulb holder as recited in claim 1 wherein a pair of said connecting parts are coupled to opposing sides of said holder part.

* * * * *